United States Patent [19]

Krieger et al.

[11] Patent Number: 4,782,736

[45] Date of Patent: Nov. 8, 1988

[54] PRESSURE-CONTROL VALVE

[75] Inventors: Karl Krieger, Wuppertal; Werner Reinelt, Bochum, both of Fed. Rep. of Germany

[73] Assignee: Hermann Hemscheidt Maschinenfabrik GmbH & Co., Wuppertal, Fed. Rep. of Germany

[21] Appl. No.: 825,736

[22] Filed: Feb. 4, 1986

[30] Foreign Application Priority Data

Feb. 11, 1985 [DE] Fed. Rep. of Germany ..... 3504553

[51] Int. Cl.[4] ..... F01B 1/00

[52] U.S. Cl. ..... 91/170 MP; 137/538

[58] Field of Search ..... 91/170 MP; 137/538, 137/495

[56] References Cited

U.S. PATENT DOCUMENTS 4,274,435 6/1981 Block ..... 137/538 X

FOREIGN PATENT DOCUMENTS 2832964 2/1980 Fed. Rep. of Germany ..... 137/538

*Primary Examiner*—William E. Wayner

*Attorney, Agent, or Firm*—Berman, Aisenberg & Platt

[57] ABSTRACT

A pressure-control valve is connected to a working cylinder of an hydraulic, walking, mine roof support on one side of the piston in the cylinder. In its function as a pressure-limiting valve, it regulates the pressure in the working cylinder in dependence upon a predetermined pressure in a control conduit which is connected to the pressure chamber of a prop of the mine roof support. Through it a spring-loaded control piston of the pressure-control valve is hydraulically loaded so as to act on a spring-loaded valve closure member in the pressure-control valve. The control piston holds the valve-closure member in the closure position if the pressure in the control conduit exceeds the predetermined pressure. If the pressure in the control conduit drops off, the valve-closure member then regulates the pressure in the working cylinder to a comparatively low value.

6 Claims, 2 Drawing Sheets

PRESSURE-CONTROL VALVE

Figure 1:
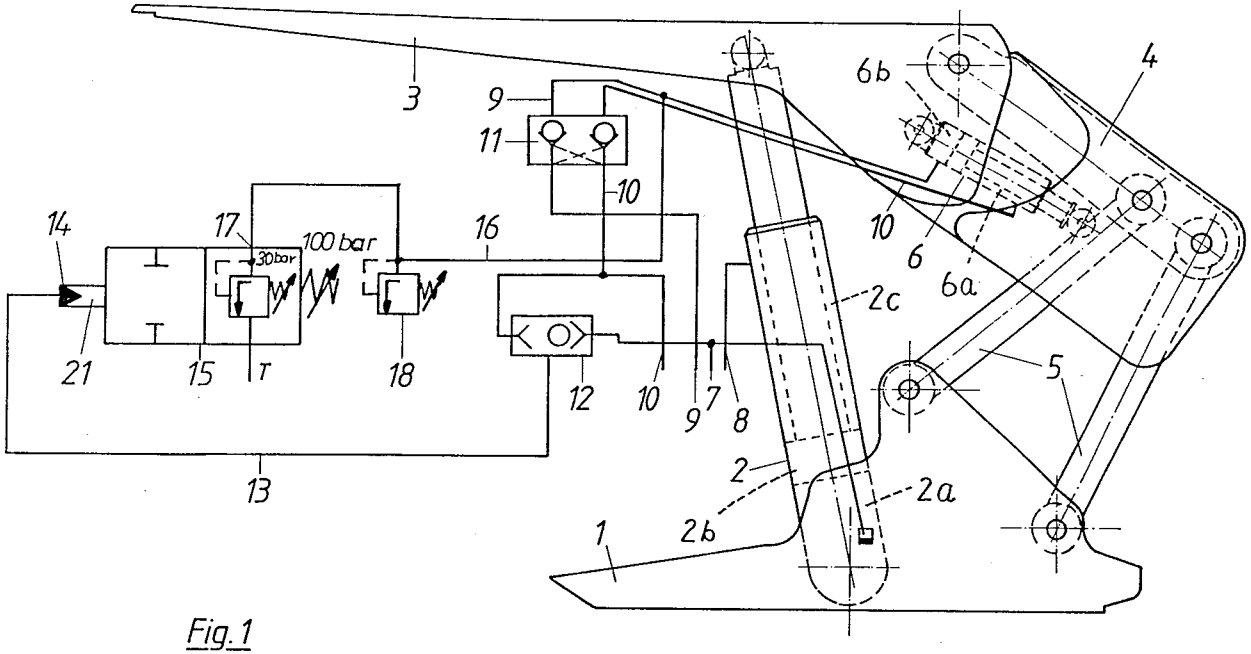

This invention relates to a pressure-control valve, especially for use in an hydraulic, walking, mine roof support.

For the purpose of regulating the pressure in the pressure chambers of the working cylinders of hydraulic, walking mine roof supports, use is made of pressure-limiting valves having valve closure members which are held closed by a spring against the applied pressure derived from the pressure chambers of the working cylinders. If the pressure in the pressure chamber of a working cylinder exceeds the set pressure, the valve connected thereto opens and pressurised fluid flows out of the pressure chamber into a low-pressure conduit so as to relieve the pressure in the cylinder. In this way, for example, the annular chamber of the angled cylinder which is arranged between the shield and the roof beam of a shield-type mine roof support is protected against damage resulting from excessive internal pressures. In order to counteract loosening and fissuring of the mine roof during the operation of shifting a walking mine roof support, the roof beams of the mine roof supports are not relieved of pressure completely but are held slidingly against the roof under moderate pressure. This, however, presumes a substantially parallel relationship between the roof and floor of the mine. In the case of a convergent road or gallery resulting from sinking of the roof or an irregularity in the floor, the roof beam will be pressed into an angled position whereby the angled cylinder is subjected to high tensile stress. Due to the consequent pressure rise in the angled cylinder, the pressure applied to the roof beam is increased in an undesirable manner with the result that the shifting operation is hindered.

With a view to overcoming the problem, German Published Specification No. 3,302,289 describes an over-pressure control valve for an hydraulic walking mine roof support which is interposed in a low-pressure circuit connected to an hydraulic prop. A spring-loaded valve closure member of the over-pressure valve is guided displaceably with a spring-loaded control piston. The spring loading of the valve closure member by way of the control piston is set so that a predetermined and generally constant counter-pressure is maintained in the pressure chamber of the prop during shifting movement of the mine roof support so that the latter can move under normal application pressure. The valve also evens out pressure rises resulting from an irregular course of the roof in relation to the floor. If the pressure in the low-pressure conduit rises as a result of a back-pressure build-up, then the valve closure member moves towards the control piston in the closure direction against the action of the spring which loads it directly.

The present invention is concerned with a further development of this pressure-control valve whereby it can be connected as a pressure-limiting valve to the pressure chamber of a working cylinder in dependence on a predetermined control pressure.

Accordingly, the invention is directed to a pressure-control valve, especially for use in an hydraulic, walking, mine roof support, comprising a valve housing containing a control piston which is hydraulically loadable against the force of an operating spring and a valve-closure member which is displaceable through a predetermined displacement distance and which, under the action of a valve-closure spring determining the opening pressure of the valve, is adapted to seal off the pressure chamber of a connected hydraulic working cylinder from a low-pressure conduit, in which the valve-closure member is securable in the closure position by the hydraulically-loaded control piston with the operating force of the operating spring being adjustable in such a manner that the control piston, in the case of a drop in the pressure of the pressurised fluid loading it below a predetermined minimum pressure, is returnable into a position in which the valve-closure member is displaceable out of the closure position into an opening position by the pressure present in the pressure chamber of the working cylinder during operation of the latter.

It will thus be seen that the valve closure member of the pressure-control valve according to the invention is controlled by a control piston and comes into action only when the pressure in a connected control conduit falls below a predetermined minimum value. Then the pressure in the connected pressure chamber of the working cylinder is kept constant at a value predetermined by the pressure-control valve. The pressure-control valve can be connected to an angled cylinder of a mine roof support—for example, in parallel with a pressure-limiting valve responding to a high set of 400 bars—and is actuated by the pressure in a prop of the mine roof support. The pressure-control valve is then in operation only during the walking action of the support, i.e., when the prop is relieved to a predetermined residual pressure. It responds as soon as pressure forces become effective on the angled cylinder during the shifting operation and regulates the pressure in the function of a pressure-limiting valve to a low set pressure—for example, of 30 bars. The pressure-control valve then holds the roof-support beam in the position adopted and, at the same time, permits an appropriate adaptation when, in the case of convergence of the roof and floor of the mine, the angular position of the roof-support beam varies in relation to the floor skid or runner of the mine roof support during shifting of the latter.

Figure 2:
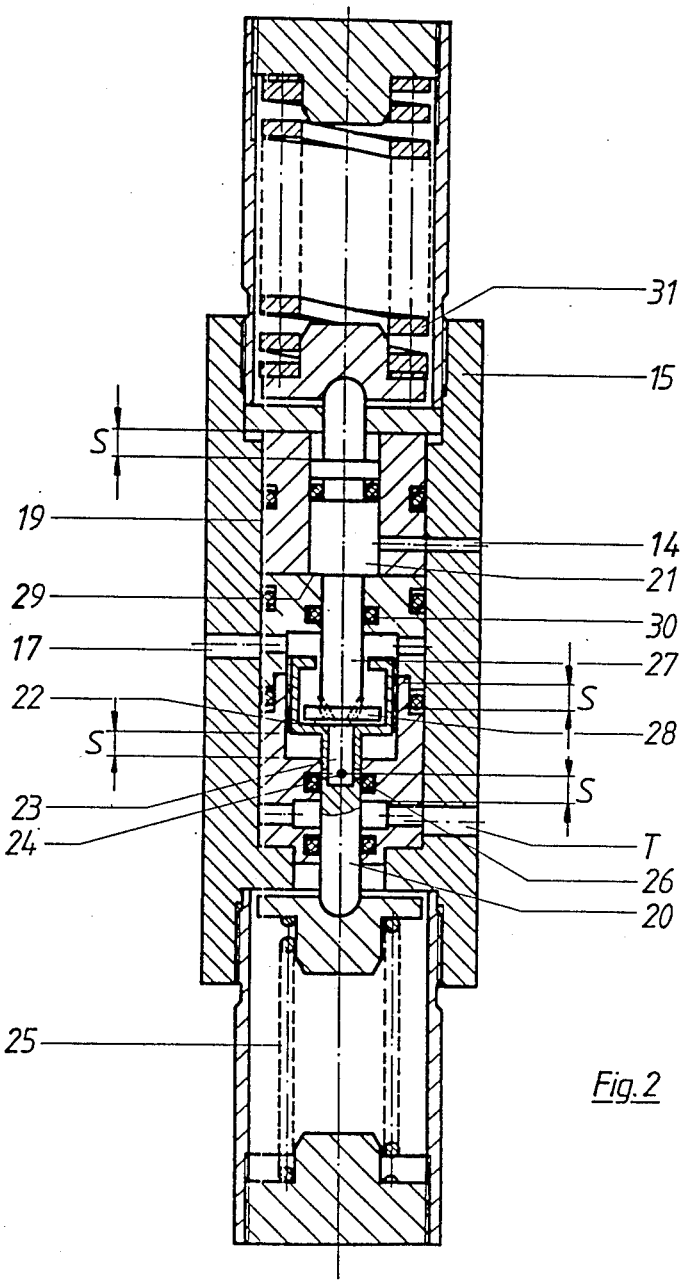

An example of a pressure-control valve in accordance with the invention is illustrated in the accompanying drawings, in which FIG. 1 shows a circuit diagram for the pressure-control valve in combination with an hydraulic shield-type mine roof support; and FIG. 2 shows the pressure-control valve in longitudinal section.

The hydraulic shield-type mine roof support shown in FIG. 1 comprises a floor skid or runner 1, two or more props 2 mounted thereon for supporting a roof-support beam 3 and a goaf shield 4 articulated on the goaf side to the roof-support beam 3. The shield is pivotably guided above the floor skid 1 by two pairs of links 5 of a lemniscate linkage. An hydraulic shifting cylinder or ram for moving the mine roof support is attached to an abutment on the working face side but is not shown in the drawing. Between the goaf shield 4 and the roof-support beam 3 there is arranged a double-acting working cylinder 6 with which the angular position of the roof-support beam 3 can be varied. This working cylinder 6 is referred to herein as the "angled" cylinder.

The pressure chamber **2*a* formed in the lower part of the prop 2 beneath its piston 2*b* is fed with pressurised fluid through a conduit 7. Similarly, a conduit 8 is provided for charging with hydraulic fluid the annular chamber 2*c* in the upper part of the prop 2 above its piston. The two chambers 6a and 6b of the angled cylinder 6 on the two sides of its piston are supplied with pressurised fluid through conduits 9 and 10, the fluid being fed through hydraulically-openable non-return valves 11**.

The conduit 7 leading to the pressure chamber 2a of the prop 2 branches to a change-over valve 12 to which the conduit 10, leading to the annular chamber 6a of the angled cylinder 6, is connected on the other side. From the change-over valve 12 a control conduit 13 branches off to open at a connection 14 into the housing 15 of the pressure-control valve which is represented in greater detail in FIG. 2. The conduit 9 leading to the pressure chamber 6b of the angled cylinder 6 branches after the non-return valve 11 into a conduit 16 which leads to a connection 17 of the pressure-control valve. A pressure-limiting valve 18 which can be set for example to a pressure of 420 bars is also connected to the conduit 16.

Referring now to FIG. 2, the valve housing 15 shown therein has a longitudinal bore 19 accommodating hollow-cylindrical guide parts and seals which are not specified in further detail. A valve-closure member 20 and a control piston 21 are mounted in the bore with each one being displaceable by a distance S in coaxial arrangement. The valve-closure member 20 is generally cylindrical in form and is provided with a hollow extension part 22 on the side facing the control piston 21. Within the valve-closure member 20 is an axial internal bore 23 which opens into the space within the extension part 22 and from which radial bores 24 issue at the deepest part of the bore. In the bores 23 and 24 pressurised fluid is present which is conducted by way of the conduits 9 and 16 to the connection 17 so that the valve-closure member 20 is loaded with pressurised fluid from the pressure chamber 6b of the angled cylinder 6. A valve-closure spring 25 supported in the valve housing 15 presses the valve-closure member 20 into the closure position of the control valve as represented in FIG. 2 wherein the radial bores 24 in the valve-closure member 20 are sealed off by a seal 26 from a low-pressure conduit T serving to receive overflowing pressurised fluid. The force of the closure spring 25 is set to a comparatively low opening pressure—for example of 30 bars. The length of the displacement distance S is predetermined by the distance between the opening and closure positions of the valve-closure member 20.

The control piston 21 which is arranged coaxially with respect to the valve-closure member 20 in the housing 15 has a stem 27 with an end 28 of flange form which engages like a plunger in the extension part 22 of the valve-closure member 20. The control piston 21 is loaded with pressurised fluid on the piston face 29, which fluid flows by way of the conduit 13 out of the pressure chamber 2a of the prop 2 to the connection of the pressure-control valve.

At the stem 27, the control piston 21 is sealed off from the connection 17 by a gasket seal 30. The control piston 21 and the valve-closure member 20 have equal cross-sectional areas in the regions of their respective seals 26 and 30.

The pressure present at the piston face 29 acts against an operating spring 31 which holds the control piston 21 in the initial position as illustrated, below a pressure of for example 100 bars, in which position the valve-closure member 20 is displaceable by the length of the displacement distance S in relation to the control piston 21.

If the prop 2 is set by means of the conduit 7, pressurised fluid also passes by way of the change-over valve 12 through the conduit 13, connected at 14, to the control piston 21. With increasing pressure, the force acting on the piston face 29 increases until it exceeds the force of the operating spring 31 and displaces the control piston 21 by the displacement distance S against the spring 31. The control piston 21 then lies with its end 28 of flange form against the inner wall, surrounding the stem 27, of the extension part 22 in such a way that it holds the valve-closure member 20 fast in the closure position. The pressure-control valve is thus set out of operation during the setting operation when a minimum pressure, predetermined by the operating spring 31, is reached in the prop 2. The connected pressure chamber 6b of the angled cylinder 6 is then protected through the high-set pressure-limiting valve 18 in the conduit 16.

If the pressure in the prop 2 drops below this minimum pressure, then the operating spring 31 presses the control piston 21 back into the initial position in which the pressure in the pressure chamber 6b of the angled cylinder 6 is again secured by means of the valve-closure member 20 of the pressure-control valve, If, during shifting of the mine roof support, pressure forces become effective upon the angled cylinder 6, then the pressure in its pressure chamber 6b rises. However, the pressure rise is limited to the set pressure of the pressure-control valve because pressurised fluid can flow out of the pressure chamber 6b of the angled cylinder 6 through the conduits 9 and 16 to the connection 17 and, by way of the opening valve-closure member 20, away to the low-pressure conduit T. With the pressure-control valve, the pressure in the pressure chamber 6b of the angled cylinder 6 is kept at the level of the desired residual pressure. The roof-support beam 3 of the support therefore remains in contact with the roof under moderate pressure and can adapt itself to irregularities in the mine roof or floor during the shifting operation without the pressure in the angled cylinder 6 rising more than is desired. In the same manner, other working cylinders of the mine roof support can be protected by a pressure-control valve in accordance with the invention.

We claim:

1. A pressure-control valve, especially for use in an hydraulic, walking, mine roof support, comprising a valve housing an hydraulically-loadable control piston in said housing, an operating spring acting on said control piston against the force of the hydraulic load, a valve-closure member in said valve housing arranged to be displaceable through a predetermined displacement distance, and a valve-closure spring acting on said valve closure member to determine the opening pressure of the valve, said valve-closure member being adapted to seal off a pressure chamber of a connected hydraulic working cylinder from a low-pressure conduit, wherein the valve-closure member is securable in the closure position by the hydraulically-loaded control piston with the operating force of the operating spring being adjustable in such a manner that the control piston, in the case of a drop in the pressure of the pressurised fluid loading it below a predetermined minimum pressure, is returnable into a position in which the valve-closure member is displaceable out of the closure position into an opening position by the pressure present in the pressure chamber of the working cylinder during operation of the latter.

2. A pressure-control valve for an hydraulic, walking, mine roof support according to claim 1, wherein the control piston comprises a stem having an end made in the form of a flange which engages in a hollow extension part of the valve-closure member and is displaceable therein by the said displacement distance, the extension part being arranged to surround the end of the control piston in such a way that the latter holds the valve-closure member fast in the closure position at the predetermined minimum pressure.

3. A pressure-control valve for an hydraulic, walking, mine roof support according to claim 1, wherein the control piston comprises an annular face loaded hydraulically through a connected control conduit, which face is larger than the cross-sectional area of the stem and the equal-size sealed cross-sectional area of the valve closure member.

4. A pressure-control valve for an hydraulic, walking, mine roof support according to claim 2, wherein the control piston is sealed off at the stem between the connections of the working cylinder and the control conduit with a gasket seal.

5. A pressure-control valve for an hydraulic, walking mine roof support according to claim 1, wherein the length of the displacement distance is given by the distance between the opening and closure positions of the valve-closure member.

6. A pressure-control valve for an hydraulic, walking mine roof support according to claim 1, wherein the control piston is hydraulically loadable through the connected control conduit with pressurised fluid from the pressure chamber of a prop of the mine roof support, and the valve-closure member is chargeable with pressurised fluid from the pressure chamber of a working cylinder which influences the angular position of a roof-support beam of the mine roof support.

* * * * *